US010967388B2

(12) United States Patent
Örtegren et al.

(10) Patent No.: US 10,967,388 B2
(45) Date of Patent: Apr. 6, 2021

(54) CENTRIFUGAL SEPARATOR HAVING A LIQUID OUTLET CHAMBER WITH A ROTATING MEMBER

(71) Applicant: ALFDEX AB, Landskrona (SE)

(72) Inventors: Anders Örtegren, Häljarp (SE); Mats Olsson, Staffanstorp (SE); Per Stjernswärd, Årsta (SE); Pedro Hernandez Fraczek, Årsta (SE); Mikael Walter, Stockholm (SE)

(73) Assignee: ALFDEX AB, Landskrona (SE)

( * ) Notice: Subject to any disclaimer, the term of this patent is extended or adjusted under 35 U.S.C. 154(b) by 618 days.

(21) Appl. No.: 15/580,343

(22) PCT Filed: May 30, 2016

(86) PCT No.: PCT/EP2016/062139
§ 371 (c)(1),
(2) Date: Dec. 7, 2017

(87) PCT Pub. No.: WO2016/198274
PCT Pub. Date: Dec. 15, 2016

(65) Prior Publication Data

US 2018/0141058 A1 May 24, 2018

(30) Foreign Application Priority Data

Jun. 10, 2015 (EP) ..... 15171302

(51) Int. Cl.
*B04B 1/08* (2006.01)
*B04B 5/00* (2006.01)
(Continued)

(52) U.S. Cl.
CPC ..... *B04B 1/08* (2013.01); *B04B 5/005* (2013.01); *B04B 7/14* (2013.01); *B04B 9/02* (2013.01);
(Continued)

(58) Field of Classification Search
CPC .. B04B 1/08; B04B 7/14; B04B 5/005; B04B 9/02; B04B 9/06; B04B 11/02;
(Continued)

(56) References Cited

U.S. PATENT DOCUMENTS 7,875,098 B2 1/2011 Hällgren et al.
8,172,917 B2 5/2012 Kup et al.
(Continued)

FOREIGN PATENT DOCUMENTS

CN 101189414 A 5/2008
CN 101203319 A 6/2008
(Continued)

OTHER PUBLICATIONS

English translation of the Japanese Office Action, dated Nov. 19, 2018, for corresponding Japanese Application No. 2018-516623.
(Continued)

*Primary Examiner* — Walter D. Griffin
*Assistant Examiner* — Shuyi S. Liu
(74) *Attorney, Agent, or Firm* — Birch, Stewart, Kolasch & Birch, LLP

(57) ABSTRACT

A centrifugal separator for separating a liquid phase from crankcase gases of an internal combustion engine includes a separation chamber, a rotor shaft, a rotor inside the separation chamber, an inlet for crankcase gases, a gas outlet, and a liquid outlet for separated liquid phase. The centrifugal separator also includes a liquid outlet chamber, a check valve, and a rotating member. The liquid outlet chamber forms an individual chamber and is arranged in fluid communication with the separation chamber via a liquid passage. The rotating member is connected to the rotor shaft and is arranged inside the liquid outlet chamber. The liquid outlet forms an outlet of the liquid outlet chamber. The check valve is arranged in the liquid outlet.

19 Claims, 2 Drawing Sheets

(51) Int. Cl.

| | |
|---|---|
| ***B04B 9/02*** | (2006.01) |
| ***B04B 9/06*** | (2006.01) |
| ***B04B 11/02*** | (2006.01) |
| ***B04B 7/14*** | (2006.01) |
| ***F01M 13/04*** | (2006.01) |

(52) U.S. Cl.
CPC ..... *B04B 9/06* (2013.01); *B04B 11/02* (2013.01); *F01M 2013/0422* (2013.01)

(58) Field of Classification Search
CPC .. B04B 5/00; F01M 2013/0422; F01M 13/04; B01D 45/12
USPC ..... 55/385.1; 277/417; 123/572, 573
See application file for complete search history.

(56) References Cited

U.S. PATENT DOCUMENTS

| | | | | |
|---|---|---|---|---|
| 9,031,768 | B2 | 5/2015 | Lagerlöf et al. | |
| 9,074,558 | B2 | 7/2015 | Roelver | |
| 9,243,528 | B2 | 1/2016 | Skoog | |
| 9,322,307 | B2 | 4/2016 | Andersson Aginger | |
| 9,452,435 | B2 | 9/2016 | Törnblom | |
| 2008/0256912 | A1* | 10/2008 | Kup | B04B 9/06 55/385.1 |
| 2011/0011380 | A1* | 1/2011 | Lagerlof | B01D 45/14 123/573 |
| 2014/0069398 | A1* | 3/2014 | Roelver | B04B 5/12 123/572 |

FOREIGN PATENT DOCUMENTS

| | | | |
|---|---|---|---|
| CN | 101970814 | A | 2/2011 |
| CN | 102953795 | A | 3/2013 |
| CN | 103097674 | A | 5/2013 |
| CN | 103501916 | A | 1/2014 |
| CN | 103702737 | A | 4/2014 |
| CN | 103889583 | A | 6/2014 |
| DE | 10 2005 021 278 | A1 | 11/2006 |
| DE | 10 2011 076 464 | A1 | 11/2012 |
| JP | 9-195968 | A | 7/1997 |
| RU | 2310760 | C2 | 11/2007 |
| RU | 2494819 | C1 | 10/2013 |
| WO | WO 2004/001202 | A1 | 12/2003 |
| WO | WO 2009/116897 | A1 | 9/2009 |
| WO | WO 2011/005160 | A1 | 1/2011 |

OTHER PUBLICATIONS

International Search Report, issued in PCT/EP2016/062139 (PCT/ISA/210), dated Aug. 17, 2016.

Written Opinion of the International Searching Authority, issued in PCT/EP2016/062139 (PCT/ISA/237), dated Aug. 17, 2016.

English translation of the Russian Decision to Grant for Application No. 2018100100, dated Sep. 14, 2018.

* cited by examiner

CENTRIFUGAL SEPARATOR HAVING A LIQUID OUTLET CHAMBER WITH A ROTATING MEMBER

TECHNICAL FIELD

The present invention relates to a centrifugal separator configured for separating a liquid phase from crankcase gases of an internal combustion engine.

BACKGROUND

Crankcase gases from an internal combustion engine are ventilated from a crankcase of the internal combustion engine. Crankcase gases may be disposed of in an environmentally friendly manner instead of being ventilated in untreated form to the atmosphere. For certain types of combustion engines, legislation requires crankcase gases to be disposed of in an environmentally friendly manner.

Crankcase gases may comprise inter alia blow-by gases, oil, other liquid hydrocarbons, soot, and other solid combustion residues. In order to dispose of crankcase gases suitably, the gas is separated from a liquid phase, which contains the oil, soot, and other residues. The separated gas may be led to an air intake of the combustion engine or vented to the atmosphere, and the liquid phase may be led back to an oil sump of the combustion engine optionally, via an oil filter for removing soot and other solid residues from the oil and the other liquid hydrocarbons.

A centrifugal separator may be utilised for disposing of crankcase gases. Separation discs of the centrifugal separator, in the form of frustoconical discs, are arranged in a disc stack with small interspaces between the separation discs. The crankcase gases are lead into the rotating disc stack and heavy constituents of the crankcase gases, such as oil and soot, are forced against inner surfaces of the separation discs and form droplets of the liquid phase as they travel along the separation discs towards an outer periphery of the disc stack. The droplets are thrown onto an inner wall of a housing of the centrifugal separator and are lead out of the centrifugal separator via a liquid outlet. The crankcase gases relived of heavy constituents are lead out of the centrifugal separator via a gas outlet.

EP 1880090 discloses an apparatus for purifying crankcase gases from a combustion engine. The apparatus comprises a housing inside which a separator chamber is provided, a rotor arrangement with a rotor shaft which is rotatably mounted in the housing and a centrifugal rotor located in the separator chamber, and a fluid driving device for driving the rotor shaft by means of a driving fluid such a lubricating oil of the combustion engine. A crankcase gas inlet leads into the separation chamber, which also comprises an outlet for gas and an oil collection channel connected to an oil collection basin. The oil collection basin is provided with an outflow opening for leading away separated oil. The driving device is disposed in a driving chamber which is separated from the separator chamber by means of a housing partition, and the rotor shaft extends through a breakthrough in the housing partition. A labyrinth-type seal is provided in the zone of the breakthrough in order to seal the driving chamber from the separator chamber. Pressure may be equalised between the driving chamber and the separation chamber via the labyrinth-type seal.

Depending on the type and condition of a relevant internal combustion engine, the pressure in its crankcase, at least temporarily, may be elevated at a level above the pressure inside the separation chamber of the centrifugal separator.

Thus, it may be problematic to feed out the separated liquid phase from the separation chamber back into the crankcase of the internal combustion engine.

SUMMARY

It is an object of the present invention to at least alleviate the above discussed problem.

According to an aspect of the invention, the object is achieved by a centrifugal separator configured for separating a liquid phase from crankcase gases of an internal combustion engine. The centrifugal separator comprises a separation chamber, a rotor shaft extending through the separation chamber, a rotor connected to the rotor shaft inside the separation chamber, an inlet for crankcase gases, a gas outlet, and a liquid outlet for separated liquid phase. The centrifugal separator further comprises a liquid outlet chamber, a check valve, and a rotating member. The liquid outlet chamber forms an individual chamber and is arranged in fluid communication with the separation chamber via a liquid passage. The rotating member is connected to the rotor shaft and is arranged inside the liquid outlet chamber. The liquid outlet forms an outlet of the liquid outlet chamber, the check valve being arranged in the liquid outlet.

Since the centrifugal separator comprises the liquid outlet chamber, which forms an individual chamber and is arranged in fluid communication with the separation chamber via a liquid passage, and since the centrifugal separator comprises the rotating member arranged inside the liquid outlet chamber, the separated liquid phase is transported by the rotating member from the separation chamber into the liquid outlet chamber, and/or from the liquid outlet chamber to the liquid outlet, while the check valve ensures that the separated liquid phase is feed out of the liquid outlet chamber as long as the pressure inside the liquid outlet chamber is higher than at a downstream side of the check valve. As a result, the above mentioned object is achieved.

In operation of the centrifugal separator crankcase gases are lead into the separation chamber and the rotor via the inlet for crankcase gases. Gas separated in the separation chamber is lead out of the separation chamber via the gas outlet. Heavy constituents of the crankcase gases, such as oil and soot, are separate in the rotor and form droplets of liquid phase. The droplets are thrown onto an inner wall of the separation chamber and are lead towards the liquid passage. All liquid phase separated in the separation chamber flows through the liquid outlet chamber on its way to the liquid outlet. That is, the separation chamber does not have any other outlet for separated liquid phase than the liquid passage leading to the liquid outlet chamber. The rotating member inside the liquid outlet chamber forms a pumping member as it is rotated with the rotor shaft. As such the rotating member may pump liquid phase from the separation chamber via the liquid passage into the liquid outlet chamber. Moreover, the rotating member may build up a pressure inside the liquid outlet chamber sufficient to press the liquid phase past the check valve, i.e. to overcome a pressure downstream of the check valve.

According to embodiments, the centrifugal separator may comprise an electric motor configured to drive the rotor shaft about a rotation axis. In this manner the rotor may be efficiently driven. Moreover, the rotating member may be efficiently driven by the electric motor together with the rotor. Thus, the rotating member does not require any separate drive means.

Driving of the rotating member may further be effected by means of a hydraulic drive. As an example, the separator may comprise a turbine wheel arranged to be rotated by means of an oil jet from the oil system of the combustion engine or a free jet wheel comprising a blow-back disk. Furthermore, the rotating member of the centrifugal separator may be mechanically driven, such as by means of a belt drive, a direct drive by a shaft or by means of a shaft in combination with one or several gears.

According to embodiments, the rotating member may be substantially circular. In this manner pumping effect may be achieved by a rotating member of comparatively uncomplicated shape.

According to embodiments, the liquid passage may be arranged within a radius of the rotating member seen in a direction along the rotor shaft. In this manner a pumping effect may be achieved as the separated liquid phase is introduced from the liquid passage within the radius of the rotating member and pumped towards a periphery of the rotating member as it is rotated.

According to embodiments, the rotor may comprise a stack of frustoconical separation discs. In this manner an efficient separation of liquid phase from the crankcase gases may be achieved as heavy constituents of the crankcase gases are forced against inner surfaces of the separation discs and form droplets of the liquid phase as they travel along the separation discs towards an outer periphery of the separation discs and the disc stack.

Further features of, and advantages with, the present invention will become apparent when studying the appended claims and the following detailed description.

BRIEF DESCRIPTION OF THE DRAWINGS

Various aspects of the invention, including its particular features and advantages, will be readily understood from the example embodiments discussed in the following detailed description and the accompanying drawings, in which.

DETAILED DESCRIPTION

Aspects of the present invention will now be described more fully. Like numbers refer to like elements throughout. Well-known functions or constructions will not necessarily be described in detail for brevity and/or clarity.

Figure 2:
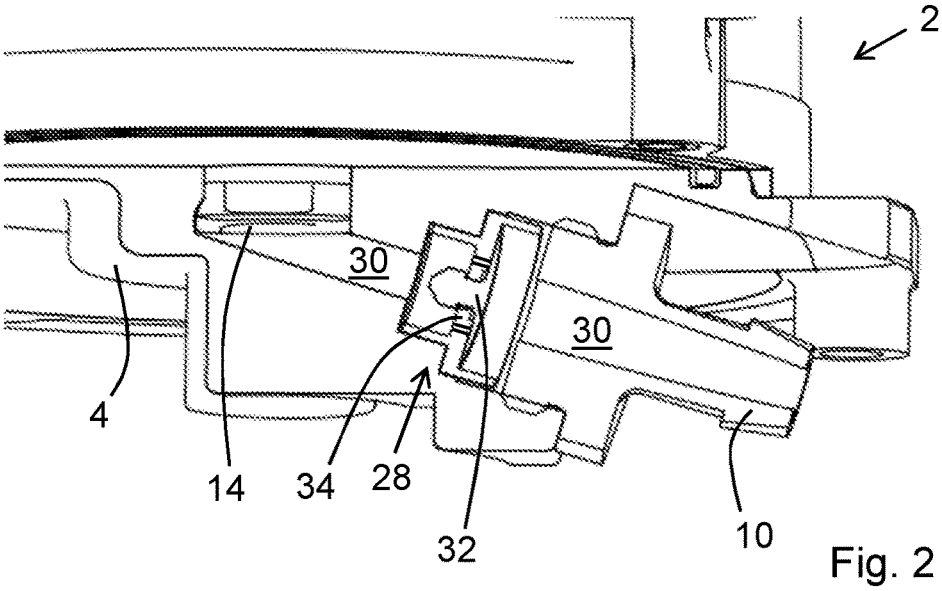
FIGS. 2 and 3 illustrate cross sections through lower portions of the centrifugal separator of FIGS. 1.

FIG. 2 illustrates a cross section through a centrifugal separator 2 according to embodiments. The centrifugal separator 2 is configured for separating a liquid phase from crankcase gases coming from an internal combustion engine. The centrifugal separator 2 comprises a housing 4, which housing 4 may comprise of a number of separate parts, which are fitted together. The centrifugal separator 2 further comprises an inlet 6 for crankcase gases, a gas outlet 8 for gas cleaned from heavy constituents of the crankcase gases, and a liquid outlet 10 for liquid phase separated from the crankcase gases. The liquid phase comprises the heavy constituents of the crankcase gases.

Inside the housing 4, the centrifugal separator 2 comprises a separation chamber 12 and a liquid outlet chamber 14. The centrifugal separator 2 further comprises a rotor 16 arranged inside the separation chamber 12, a rotating member 18 arranged inside the liquid outlet chamber 14, and a rotor shaft 20 extending through the separation chamber 12 and the liquid outlet chamber 14. The rotor 16 and the rotating member 18 are connected to the rotor shaft 20.

The centrifugal separator 2 comprises an electric motor 22 connected to the rotor shaft 20. The electric motor 22 is configured to drive the rotor shaft 20 about a rotation axis 24. In these embodiments the electric motor 22 is connected to an upper end of the rotor shaft 20. In alternative embodiments an electric motor may be connected to a lower end of the rotor shaft 20.

The rotor 16 comprises a stack of frustoconical separation discs 26. In the stack, the frustoconical separation discs 26 are stacked abutting against each other. For clarity reasons this has been illustrated in FIG. 2 only at lower and upper ends of the stack. In these embodiments the frustoconical separation discs 26 are stacked with their wide ends facing downwardly. In alternative embodiments, the frustoconical separation discs 26 may be stacked with their wide ends facing upwardly.

Figure 1:
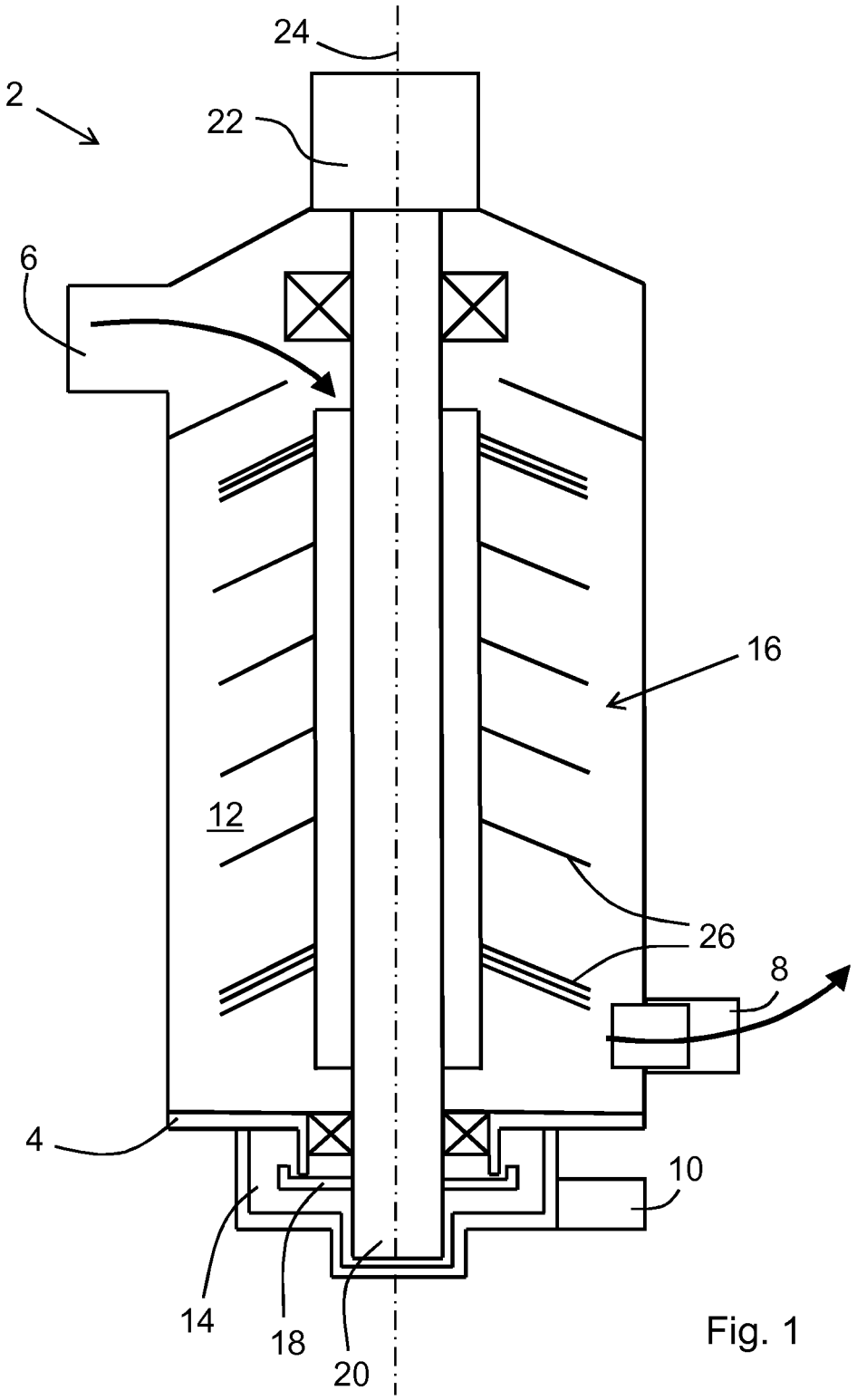
FIG. 1 illustrates a cross section through a centrifugal separator according to embodiments.

FIG. 2 illustrates a cross section through a lower portion of the centrifugal separator 2 of FIG. 1. More specifically, FIG. 2 illustrates a cross section through a portion of the liquid outlet 10 and a portion of the housing 4 at the liquid outlet chamber 14.

The centrifugal separator 2 comprises a check valve 28. The check valve 28 is arranged in a passage 30. The passage 30 extends from the liquid outlet chamber 14 and through the liquid outlet 10. The check valve 28 prevents flow of fluid into the liquid outlet chamber 14 via the liquid outlet 10. Thus, crankcase gases may be prevented from entering the centrifugal separator 2 via the liquid outlet 10. The check valve 28 comprises an umbrella valve, i.e. the check valve 28 comprises an umbrella-shaped resilient member 32 and a wall member 34 comprising one or more through holes. The resilient member 32 abuts against the wall member 34. If the pressure is higher upstream of the umbrella valve than downstream of the umbrella valve, the resilient member 32 will give way and liquid may flow through the one or more through holes past the resilient member. If the pressure is higher downstream of the umbrella valve than upstream of the umbrella valve, the resilient member 32 will be pressed against the wall member 34 and will remain covering the one or more through holes.

Naturally, a different type of check valve may alternatively be used in the liquid outlet 10 of the centrifugal separator 2.

Figure 3:
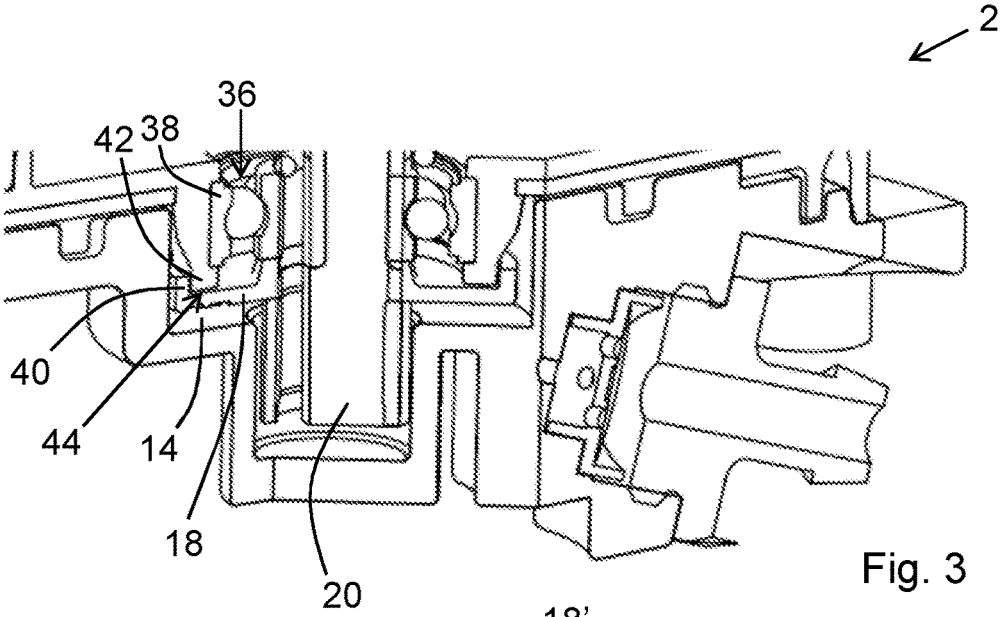

FIG. 3 illustrates a cross section through a lower portion of the centrifugal separator 2 of FIGS. 1 and 2. More specifically, FIG. 3 illustrates a cross section through a portion of the separation chamber 12 and through the liquid outlet chamber 14.

The liquid outlet chamber 14 is arranged at a lower end of the centrifugal separator 2, when the centrifugal separator 2 is arranged to operate together with a relevant internal combustion engine. The liquid outlet chamber 14 forms an individual chamber, i.e. the liquid outlet chamber 14 forms a compartment separate from the separation chamber 12. However, the liquid outlet chamber 14 is arranged in fluid communication with the separation chamber 12 via a liquid passage 36. Moreover, the liquid outlet 10 of the centrifugal separator 2 forms an outlet of the liquid outlet chamber 14. Accordingly, the separation chamber 12 is arranged upstream of the liquid passage 36, the liquid outlet chamber 14 is arranged downstream of the liquid passage 36, and the liquid outlet 10 is arranged downstream of the liquid outlet chamber 14.

The liquid passage 36 extends from the bottom of the separation chamber 12 to the liquid outlet chamber 14. The separated liquid phase settles in the separation chamber 12 at the bottom of the separation chamber 12. Thus, the liquid phase will settled at the liquid passage 36. Accordingly, the centrifugal separator 2 is configured for all separated liquid phase to flow from the separation chamber 12 via the liquid passage 36 and the liquid outlet chamber 14, and through the liquid outlet 10 out of the centrifugal separator 2.

The rotating member 18 is substantially circular and is arranged inside the liquid outlet chamber 14. As the rotating member 18 is rotated by the rotor shaft 20, the separated liquid phase is displaced from the liquid outlet chamber 14 to the liquid outlet 10 and out of the centrifugal separator 2, by the pressure built up in the liquid outlet chamber 14 by the rotating member 18. Moreover, the arrangement of the rotating member 18 in the liquid outlet chamber 14, as discussed below, provides a pumping effect, which pumps liquid phase from the separation chamber 12 into the liquid outlet chamber 14

The liquid passage 36 extends through a wall portion extending between the separation chamber 12 and the liquid outlet chamber 14. In these embodiments the liquid passage 36 extends through a bearing 38, which is arranged to journal the rotor shaft 20. The wall portion extending between the separation chamber 12 and the liquid outlet chamber 14 is a wall portion of the housing 4 delimiting the separation chamber 12 from the liquid outlet chamber 14. The bearing 38 is an open ball bearing fitted in the wall portion. The liquid passage may be provided by alternative means, such as through a different kind of bearing, or by holes extending through the wall portion. Suitably, the liquid passage 36 should be arranged within a radius of the rotating member 18 seen in a direction along the rotor shaft 20. Thus, the above-mentioned pumping effect may be achieved, as the separated liquid phase is introduced from the liquid passage 36 within the radius of the rotating member 18 and pumped towards a periphery of the rotating member 18 as the rotating member 18 rotates.

The rotating member 18 comprises at least one axially extending first circular flange 40. The at least one axially extending first circular flange 40 faces in a direction of the liquid passage 36. The first circular flange 40 is in these embodiments arranged at the outer periphery of the rotating member 18. A wall portion of the liquid outlet chamber 14 at the liquid passage 36 comprises a second circular flange 42 extending towards the rotating member 18. Between the second circular flange 42 and the rotating member 18 a gap 44 is formed. Accordingly, seen in a view perpendicularly to the rotor shaft 20, the first circular flange 40 overlaps at least partially the second circular flange 42. The gap 44 suitably, may have a height of up to 0.9 mm. A gap 44 of such height may contribute to the above-discussed pumping effect on a liquid phase separated from crankcase gases of an internal combustion engine, as the rotating member 18 is rotated.

Referring now to FIGS. 1-3, the inlet 6 may be arranged in a permanent open connection with an internal space of a crankcase of the internal combustion engine, of which the crankcase gases are to be treated in the centrifugal separator 2. In operation, crankcase gases enter the centrifugal separator 2 via the inlet 6 and are lead via passages into a central portion of the rotor 16. Gas separated in the separation chamber 12 is lead out of the separation chamber 12 via the gas outlet 8. Heavy constituents of the crankcase gases, such as oil and soot, are separate in the rotor 16 and form droplets of liquid phase. The droplets are thrown onto an inner wall of the separation chamber 12 and are lead towards the liquid passage 36. All liquid phase separated in the separation chamber 12 flows via the liquid outlet chamber 14 on its way to the liquid outlet 10. That is, the separation chamber 12 does not have any other outlet for separated liquid phase than the liquid passage 36 leading to the liquid outlet chamber 14. The rotating member 18 inside the liquid outlet chamber 14 forms a pumping member as it is rotated with the rotor shaft 20, by the electric motor 22. As such the rotating member 18 may pump liquid phase from the separation chamber 12 via the liquid passage 36 into the liquid outlet chamber 14. Moreover, the rotating member 18 may build up a pressure inside the liquid outlet chamber 14 sufficient to press the liquid phase past the check valve 28, i.e. to overcome a pressure downstream of the check valve 28.

The pressure inside a crankcase of an internal combustion engine may be within a range of 10-50 mbar above ambient pressure around the internal combustion engine. Accordingly, the rotating member 18 has to build up a pressure inside the liquid outlet chamber 14 to overcome such a pressure in order to transfer liquid phase, separated from the crankcase gases, back into the crankcase of a relevant internal combustion engine.

Depending on the size of internal combustion engine, of which crankcase gases are to be treated, and thus mentioned purely as an example, the electric motor 22 may rotate the rotor shaft 20 at a speed of 6.000-10.000 rpm. The separation discs 20 may have an outer diameter within a range of 100-200 mm. The stack of frustoconical separation discs 26 may comprise 30-80 discs 26.

Figure 4:
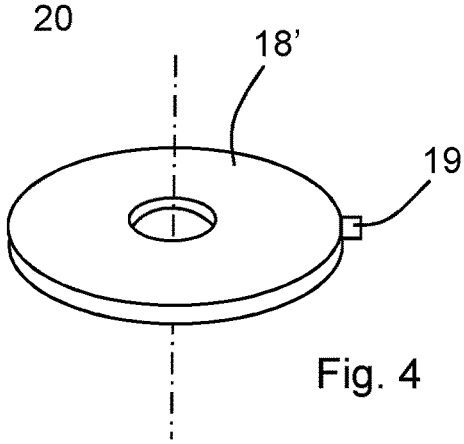
FIG. 4 illustrates a rotating member according to embodiments.

FIG. 4 illustrates a rotating member 18' according to alternative embodiments. The rotating member 18' is configured to be arranged in a liquid outlet chamber of a centrifugal separator as discussed above in connection with FIGS. 1-3. The rotating member 18' comprises at least one radially extending blade 19. Alternatively, the rotating member 18' may comprise at least one axially extending blade.

The term blade is to be interpreted in a broad sense and incorporates any member extending from a periphery of the rotating member e.g. a vane, a lobe. The inner shape of the liquid outlet chamber may cooperate with the at least one extending blade as in a pump, i.e. to build up a pressure in a portion of the liquid outlet chamber, which pressure displaces liquid phase from the liquid outlet chamber via the liquid outlet. A slight pressure build-up suffices to overcome that of a crankcase connected to the liquid outlet 10.

This invention should not be construed as limited to the embodiments set forth herein. A person skilled in the art will realize that different features of the embodiments disclosed herein may be combined to create embodiments other than those described herein. Therefore, it is to be understood that the foregoing is illustrative of various example embodiments and that the invention is defined only by the appended claims.

As used herein, the term "comprising" or "comprises" is open-ended, and includes one or more stated features, elements, steps, components or functions but does not preclude the presence or addition of one or more other features, elements, steps, components, functions or groups thereof.

The invention claimed is:

1. A centrifugal separator configured for separating a liquid phase from crankcase gases of an internal combustion engine, the centrifugal separator comprising:

a separation chamber;

a rotor shaft extending through the separation chamber;

a rotor connected to the rotor shaft inside the separation chamber;

an inlet for crankcase gases;

a gas outlet;

a liquid outlet for separated liquid phase;

a liquid outlet chamber having an upper wall and a lower wall;

a check valve; and a rotating member, wherein the liquid outlet chamber forms an individual chamber and is arranged in fluid communication with the separation chamber via a liquid passage, wherein the rotating member is connected to the rotor shaft and is arranged inside the liquid outlet chamber between the upper wall and lower wall of the liquid outlet chamber, and wherein the liquid outlet forms an outlet of the liquid outlet chamber, the check valve being arranged in the liquid outlet.

2. The centrifugal separator according to claim 1, further comprising an electric motor configured to drive the rotor shaft about a rotation axis.

3. The centrifugal separator according to claim 1, wherein the rotating member comprises at least one axially extending first circular flange, the at least one axially extending first circular flange facing in a direction of the liquid passage.

4. The centrifugal separator according to claim 3, wherein a wall portion of the liquid outlet chamber at the liquid passage comprises a second circular flange extending towards the rotating member.

5. The centrifugal separator according to claim 4, wherein seen in a view perpendicularly to the rotor shaft, the first circular flange overlaps at least partially the second circular flange.

6. The centrifugal separator according to claim 1, wherein the rotating member is substantially circular.

7. The centrifugal separator according to claim 1, wherein the rotating member comprises at least one radially or axially extending blade.

8. The centrifugal separator according to claim 1, wherein the check valve comprises an umbrella valve.

9. The centrifugal separator according to claim 1, wherein the liquid passage extends through a wall portion extending between the separation chamber and the liquid outlet chamber.

10. A centrifugal separator configured for separating a liquid phase from crankcase gases of an internal combustion engine, the centrifugal separator comprising:

a separation chamber;

a rotor shaft extending through the separation chamber;

a rotor connected to the rotor shaft inside the separation chamber;

an inlet for crankcase gases;

a gas outlet;

a liquid outlet for separated liquid phase;

a liquid outlet chamber;

a check valve; and a rotating member, wherein the liquid outlet chamber forms an individual chamber and is arranged in fluid communication with the separation chamber via a liquid passage, wherein the rotating member is connected to the rotor shaft and is arranged inside the liquid outlet chamber, wherein the liquid outlet forms an outlet of the liquid outlet chamber, the check valve being arranged in the liquid outlet, and wherein the liquid passage is arranged within a radius of the rotating member seen in a direction along the rotor shaft.

11. A centrifugal separator configured for separating a liquid phase from crankcase gases of an internal combustion engine, the centrifugal separator comprising:

a separation chamber;

a rotor shaft extending through the separation chamber;

a rotor connected to the rotor shaft inside the separation chamber;

an inlet for crankcase gases;

a gas outlet;

a liquid outlet for separated liquid phase;

a liquid outlet chamber;

a check valve; and a rotating member, wherein the liquid outlet chamber forms an individual chamber and is arranged in fluid communication with the separation chamber via a liquid passage, wherein the rotating member is connected to the rotor shaft and is arranged inside the liquid outlet chamber, wherein the liquid outlet forms an outlet of the liquid outlet chamber, the check valve being arranged in the liquid outlet, and wherein the liquid passage extends through a bearing arranged to journal the rotor shaft.

12. The centrifugal separator according to claim 1, wherein the rotor comprises a stack of frustoconical separation discs.

13. The centrifugal separator according to claim 1, wherein the separation chamber is arranged upstream of the liquid passage, wherein the liquid outlet chamber is arranged downstream of the liquid passage, and wherein the liquid outlet is arranged downstream of the liquid outlet chamber.

14. The centrifugal separator according to claim 1, wherein the centrifugal separator is configured for all separated liquid phase to flow from the separation chamber via the liquid passage and the liquid outlet chamber, and through the liquid outlet out of the centrifugal separator.

15. The centrifugal separator according to claim 2, wherein the rotating member comprises at least one axially extending first circular flange, the at least one axially extending first circular flange facing in a direction of the liquid passage.

16. The centrifugal separator according to claim 1, wherein a wall portion of the liquid outlet chamber at the liquid passage comprises a circular flange extending towards the rotating member.

17. The centrifugal separator according to claim 2, wherein the rotating member is substantially circular.

18. The centrifugal separator according to claim 3, wherein the rotating member is substantially circular.

19. The centrifugal separator according to claim 1, wherein the rotating member comprises at least one radially extending blade.

* * * * *